United States Patent [19]

Chang

[11] 4,425,386

[45] Jan. 10, 1984

[54] MULTI-SHEET ASSEMBLY USING AUTOGENOUS COATING

[75] Inventor: John C. H. Chang, Naperville, Ill.

[73] Assignee: Wallace Computer Services, Inc., Hillside, Ill.

[21] Appl. No.: 395,870

[22] Filed: Jul. 7, 1982

[51] Int. Cl.[3] ..... B41M 5/16; B41M 5/22

[52] U.S. Cl. ..... 427/256; 101/DIG. 1; 229/68 R; 229/72; 229/75; 282/27.5; 427/150; 427/151; 427/152; 427/153; 427/261; 427/288; 428/195; 428/211; 428/320.8; 428/537; 428/914

[58] Field of Search ..... 282/27.5; 427/150–153, 427/256, 261, 288; 428/320.8, 537, 913, 914, 195, 207, 211, 411; 101/DIG. 1; 229/68 R, 72, 75

[56] References Cited

U.S. PATENT DOCUMENTS 3,914,511 10/1975 Vassiliades ..... 428/411
4,012,554 3/1977 Miller et al. ..... 428/327
4,112,138 9/1978 Davis et al. ..... 282/27.5
4,172,605 10/1979 Welsch et al. ..... 282/27.5
4,199,174 4/1980 Sornberger ..... 282/27.5

FOREIGN PATENT DOCUMENTS 945443 4/1974 Canada ..... 117/15

*Primary Examiner*—Bruce H. Hess
*Attorney, Agent, or Firm*—Roylance, Abrams, Berdo & Goodman

[57] ABSTRACT

A multi-ply business form comprising a plurality of sheets in superposed relationship wherein the top sheet comprises a support bearing a localized coating comprising both microscopic pressure rupturable capsules containing a chromogenic material, and an electron acceptor material. At least one underlying sheet can comprise a support bearing a second localized autogenous coating comprising chromogen-containing microscopic pressure rupturable capsules and an electron acceptor material on its upper surface wherein the localized autogenous coatings are non-coextensive.

20 Claims, 5 Drawing Figures

MULTI-SHEET ASSEMBLY USING AUTOGENOUS COATING

FIELD OF THE INVENTION

This invention relates to a multi-sheet business form, a printing system for producing printed multi-ply business forms, and to a method for forming visible images in a multi-ply business form. More particularly, this invention relates to a multi-sheet envelope assembly which utilizes autogenous coatings to produce mailer forms in which data can be generated on both the inside and the outside by computer printing devices.

DESCRIPTION OF THE PRIOR ART

Mailer form assemblies known as "mailers" are stuffed, sealed envelopes which are processed through computer printers to provide various information on both the outside of the envelope and the interior of the mailer without the need for manually handling, stuffing, sealing or stamping each envelope. Such mailers are described in U.S. Pat. Nos. 3,777,971; 3,830,141; 3,988,971; 4,081,127; and 4,095,965, the disclosures of which are hereby incorporated by reference.

Various techniques have been utilized to provide data on both the outer plies and the inner plies of the mailer forms. One difficulty in the production of such mailers involves the printing of the outside of the envelope with only addressee information and without other information which must be provided on the inner plies. Certain mailers hide the extraneous information by using unreadable, printed characters to cover the extraneous information and render it unintelligible. However, the appearance of the envelope is undesirable. Other mailers employ spot coatings of carbon ink on the backside of a top record sheet to provide the address information on the front of the envelope to the exclusion of extraneous information. However, such record sheets employ expensive carbonizing bond paper to prevent penetration of carbon ink. Not only are such sheets expensive, but they are normally discarded prior to mailing because the data information contained thereon is generally stored in a computer making retention of the record sheet unnecessary and burdensome. Other mailers incorporate carbon ink spot coated carbon tissue in the form of a brownish thin sheet, which is located between the top record sheet and the glued mailer. This assembly has the drawback that the carbon tissue must be deleaved and disposed of before the envelope is mailed to the addressee. Such carbon ink spot coated carbonizing bond paper and carbon tissue sheets have been used between the inner plies of the glued mailer, but they have the drawback in such application of being not only costly but causing smudging of the image receiving ply.

U.S. Pat. No. 4,172,605 proposes the use of a chemically reactive ribbon in which the ribbon for the printer is coated with a color forming chromogenic substance in solution so as to develop images on a coating of color developer material in selected areas, for example on the front of the mailer. However, such ribbons are expensive and must be replaced frequently, thereby slowing down the printing operation. Moreover, the ribbon must be in direct contact with the underlying receiving sheet so as to permit transfer of the chromogenic material to the developer coating to provide an image.

SUMMARY OF THE INVENTION

A multi-sheet business form assembly has now been found which comprises a plurality of sheets in a superposed relationship wherein the top sheet comprises a support bearing a localized, autogenous coating which comprises both chromogen-containing microscopic pressure rupturable capsules and an electron acceptor material, on the upper surface of the top sheet, which form can be used in combination with a printing stylus, such as that in a typewriter or computer printer to provide visible images in the localized autogenous coating upon impact of the stylus, and without the need for a chromogen-impregnated ribbon or, any ribbon whatsoever. The autogenous or self-contained coating of the present invention contains both chromogen-containing microcapsules and the electron-acceptor material, so that upon impact of the stylus and rupture of the capsules, the chromogen is released and reacts with electron-acceptor in the very same coating and without transfer.

The record system of the present invention may further comprise multiple plies in which at least one underlying sheet comprises a support bearing a second localized autogenous coating comprising both chromogen-containing microscopic pressure rupturable capsules and an electron acceptor material on its upper surface, wherein the autogenous coatings are non-coextensive. In this embodiment of the present invention the use of carbon ink spot coated carbonizing bond paper or carbon tissue sheet can be completely eliminated, thus reducing the cost of mailer assembly. Thus, the localized autogenous coating of the present invention can be spot coated on the upper surface of each ply where it is desired to provide particular data thereby eliminating transfer coatings on the underside of a top record sheet for providing the addressee information or on the underside of an inner ply for providing information by transfer to an underlying ply.

Thus, according to one embodiment of the present invention, the printer is utilized without any ribbon whatsoever thereby eliminating the cost of ribbons.

According to another embodiment of the present invention, a shield can be used between the stylus of the printer and the top sheet of the mailer assembly to avoid embossment caused by the impact of the printer key in the case of, for example, hard hit printers. However, such shielding means, such as a blank ribbon devoid of chromogen or other chemically reacting material, can likewise be eliminated, for example, in the case of moderately hit high speed printers.

DETAILED DESCRIPTION OF THE PREFERRED EMBODIMENTS OF THE INVENTION

Figure 1:
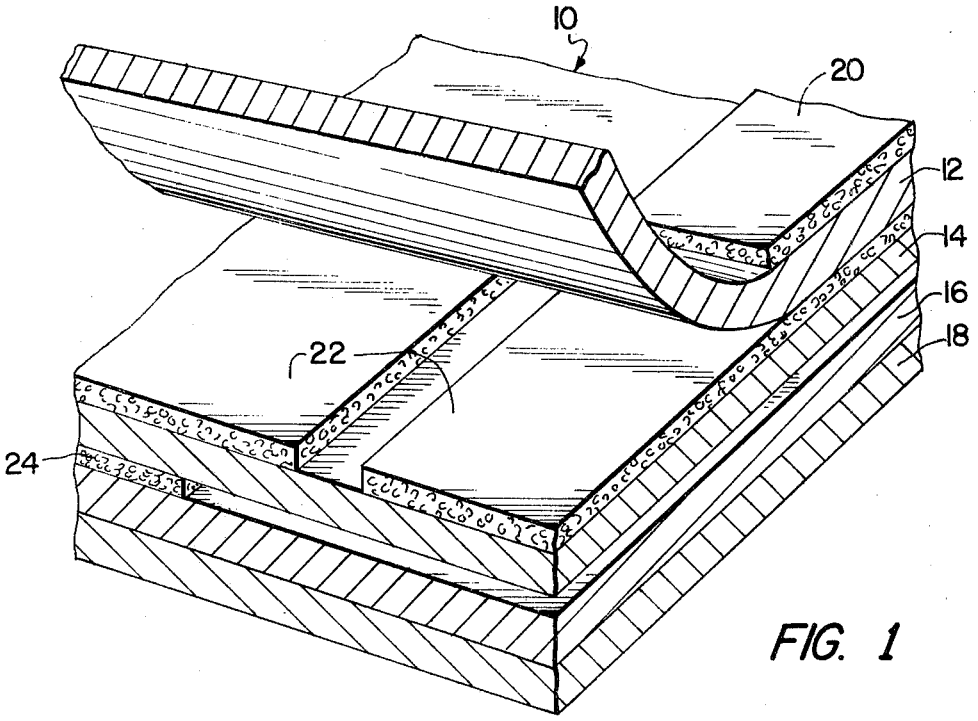
FIG. 1 is a partial, schematic and perspective view of a multi-ply business form according to the present invention.

Referring initially to FIG. 1, the multi-ply business form 10 of the present invention comprises a plurality of paper sheets in superposed relationship. In the illustrated embodiment, there are four sheets or plies 12,14,16 and 18.

Top outer sheet 12 has on its upper or outer surface at least one localized or spot coated autogenic coating 20 comprising both chromogen-containing microscopic, pressure rupturable capsules and an electron acceptor material. Autogenic coating 20, along with other localized coatings which can be provided on the outer surface of sheet 12, can cover substantially less than the entire surface of sheet 12. A printing stylus applying pressure to the outer surface of top sheet 12 only forms visible images in the localized coating 20 upon impact directly under the stylus. No visible images are formed on the outer surface of top ply 12 when the stylus contacts the top sheet upper surface outside the area of the localized coating. In this manner, the visible images on the outer surface of sheet 12 are formed without a chromogen-impregnated ribbon or any other image forming ribbon since coating 20 is autogenous.

Second sheet 14 supports an autogenous coating 22 which can be localized or cover substantially the entire surface of sheet 14. Coating 20 and coating 22 are not coextensive. Thus, a printing stylus contacting the outer surface of sheet 12 outside of coating 20 will form no visible image on sheet 12, but will form a visible image on sheet 14 if the impact occurs within the area of coating 22. By preselecting the coating areas on sheets 12 and 14, all printing can be accomplished in a single sweep by the printing stylus contacting only the outer surface of sheet 12 while selectively forming each character only on sheet 12, only on sheet 14, or on both sheet 12 and sheet 14.

Sheet 16 can also support localized autogenous coatings 24 to form selected visible images thereon by the printer stylus contacting sheet 12. Sheet 18 can comprise a backing sheet.

Autogenous coating 20 may be formed using any formulation normally utilizable in the production of self-containing copy sheets to provide an autogenous layer comprising both pressure-rupturable microcapsules, which contain chromogenic material (color-precursors), and electron-acceptor (color-developer) material. For example, suitable formations for preparing autogenic or self-contained coatings are described in U.S. Pat. Nos. 3,906,123; 3,663,256; 3,732,120; 3,554,781; 3,576,660; 4,170;488; and 4,197,346, the disclosures of which are hereby incorporated by reference.

The autogenous coating comprises microcapsules having walls formed, for example, from coacervated gelatin, polycondensates from interfacial cross-linking, or hydrolyzed isocyanatoamidine product. Preferably, the microcapsules are formed by a microencapsulation process described in U.S. Pat. No. 4,317,743 to J. C. H. Chang dated Mar. 2, 1982, the disclosure of which is hereby incorporated by reference. Preferred electron-acceptor materials for inclusion in the autogenous layer are the Lewis acids conventionally used to prepare carbonless copy papers. Preferred Lewis acids include, for example, alkylphenol-formaldehyde novolac resins, zinc salts of alkylsalicylic acids, acid activated clays, and the like.

The microcapsules contain an oily solution of a chromogen. Suitable chromogens include, for example, crystal violet lactone, benzoyl leuco methylene blue, fluorans, phthalides, rhodamine lactams, and the like. Suitable chromogens are disclosed, for example, in U.S. Pat. Nos. 3,954,803 and 4,012,419 to D. N. Vincent and C. H. Chang, which are hereby incorporated by reference.

The microcapsules may be of any suitable size, for example, and have an average diameter of between about 1 to about 20 microns, preferably, between about 3 to about 7 microns. The amount of chromogen used is generally the amount needed to react with the Lewis acid in the autogenous layer, and may be present in amounts of, for example, from about 5 parts by weight to about 20 parts by weight chromogen, preferably, from about 8 parts by weight to about 15 parts by weight chromogen per 100 parts by weight electron acceptor in the autogenous layer.

Preferably, the autogenous layer additionally contains a color suppressant to prevent premature coloration during the coating process. The color suppressant must be so chosen that it will not inhibit or adversely affect the color formation in the final product. Preferred color suppressants include, for example, ammonium hydroxide, alkanolamines, such as monoethanolamine, diethanolamine, N,N-dimethylethanolamine, and the like, condensates of amine-formaldehyde, such as urea-formaldehyde, melamine-formaldehyde, and the like. Suitable amounts of such color suppressants include from about 0.1 to about 10, preferably from about 0.5 to about 4 percent by weight based on the total dry weight of the coating composition. Other suitable color suppressants are disclosed, for example, in U.S. Pat. Nos. 4,010,292 and 4,170,483, which are hereby incorporated by reference.

Figure 2:
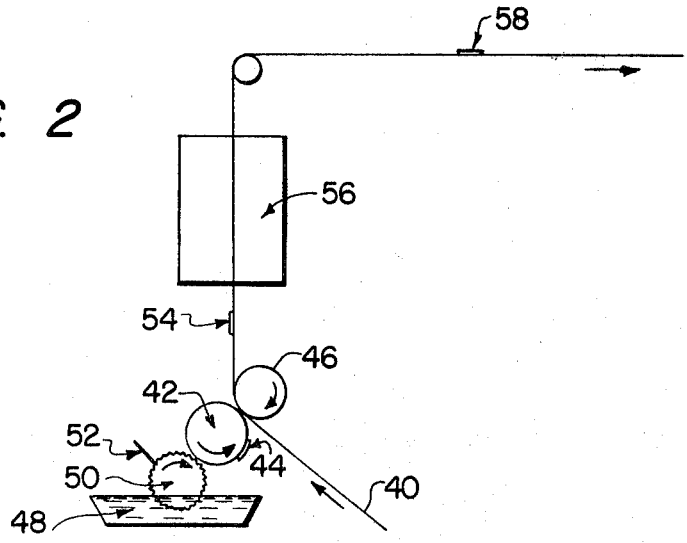
FIG. 2 is a schematic elevational view of a preferred coating system for preparing spot coated plies for use in the business forms of the invention.

Any suitable means may be utilized for applying a spot or localized coating of the autogenous slurry, which comprises a mixture of microcapsules and electron acceptor material, to the paper substrate. A preferred system is shown in FIG. 2 wherein paper web 40 passes through a nip formed by cylinder roll 42, which carries a generally rectangular plate 44. Roll 42 is in nip-forming relation with roll 46. The autogenous coating material is provided in slurry form in feed tray 48 and is picked up by etched gravure cylinder 50, which is provided with a reverse-angled doctor blade 52. The autogenous coating is transferred from roll 50 to plate 44 which then comes in contact with paper web 40 to provide a spot coating 54 on the web. The spot coated web is then passed through dryer 56 and the dried spot coating 58 is passed to a wind-up roll (not shown). Surprisingly, the two-roll gravure offset unit of FIG. 2 provides a very uniform self-contained spot coating with a controlled coat weight.

Figure 3:
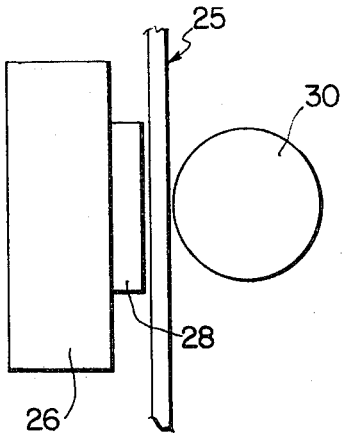
FIG. 3 is a partial, schematic and side elevational view of a continuous form stationary assembly being contacted by the stylus of a computer controlled printing head imprinting data on various plies thereof according to one embodiment of the invention.
Figure 4:
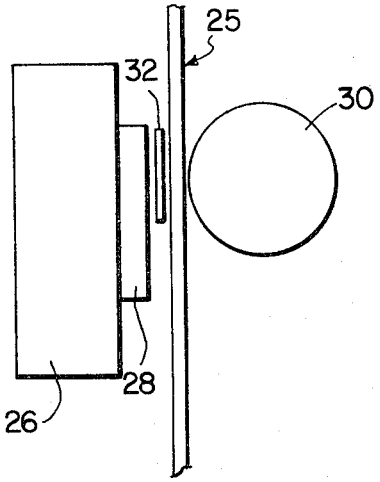
FIG. 4 is a partial, schematic and side elevational view of a continuous form stationary assembly being contacted by the stylus of a computer controlled printing head imprinting data on various plies thereof according to a second embodiment of the invention.

FIGS. 3 and 4 schematically illustrate two alternative systems for printing business forms 25. Each embodiment includes a computer controlled printer 26 having a printer head or stylus 28. The business forms are passed between printing head 28 and a backup roll 30. Printer 28 and the feed of business forms 25 can be controlled automatically by the computer. The visible images on the sheets are formed by impact of the stylus against the outer surface of sheet 12 either directly (as illustrated in FIG. 3) or through a buffer or shield 32 (as illustrated in FIG. 4). Shield 32 prevents embossing of sheet 12 by the impact of the printer stylus which can occur in hard hit printers and protects the stylus from becoming clogged with pressure sensitive material used to form colored markings. The shield can be an endless loop ribbon of a woven fabric or a synthetic material which passes between printer stylus 28 and business forms 10 during the printing operation, but which does not bear any pressure sensitive material used to form a colored marking, such as carbon, a chromogen or the like.

Visible images are formed in the coated areas on the sheets by direct or indirect impact on the coatings 20,22 and 24. No visible image is formed on any sheet when impact occurs on a particular sheet outside of the area of an autogenous coating thereon.

Coatings 22 and 24 for forming images on the inner plies 14 and 16, can be replaced by other image forming systems. For example, carbon spots can be formed on the bottom surface of sheet 12 and the bottom surface of sheet 14, or on separately interleaved plies, to form visible images on inner plies 14 and 16, respectively. Additionally, a microencapsulated color former may be coated on one of two adjacent ply surfaces with a color developer on the lower of the two adjacent ply surfaces to form a colored image on the lower of the two adjacent plies by impacting the outer surface of the upper of the two adjacent plies. Thus, coating 24 as illustrated in FIG. 1 can be a transfer medium, such as a carbon spot or such as a color developer or former, formed on the lower surface of underlying sheet 14.

Figure 5:
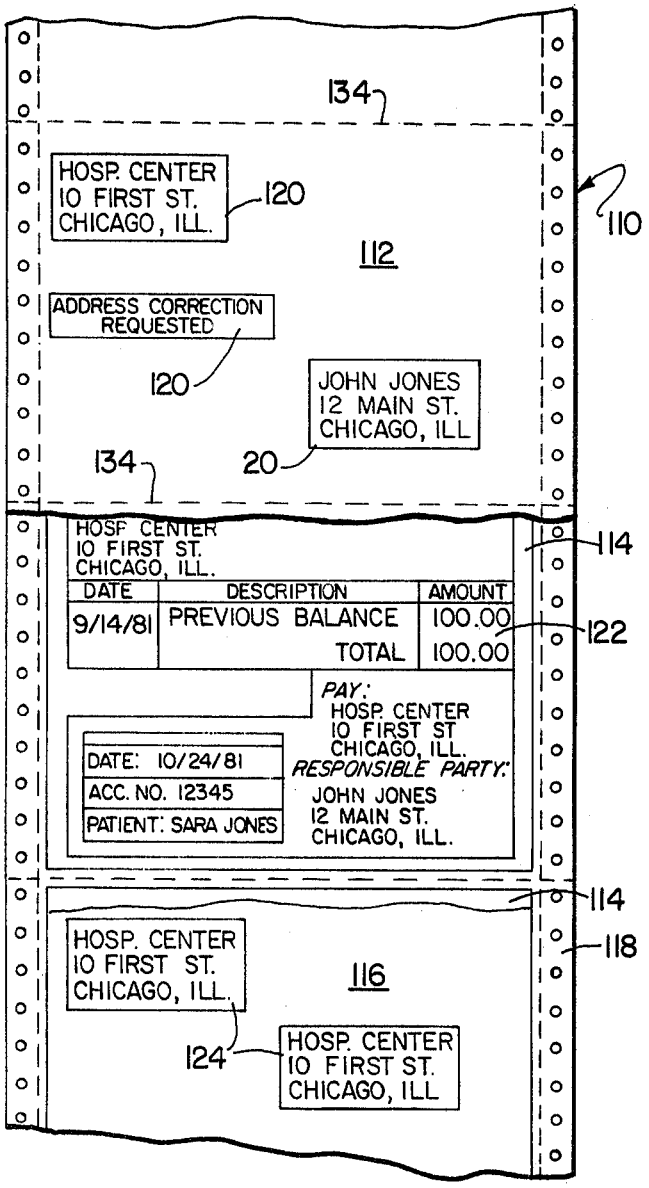
FIG. 5 is a top plan, partially sectioned view of a multi-ply business form according to the present invention.

A typical use of the business form of the present invention is illustrated by the mailer of FIG. 5. With this mailer, the information printed on the various plies is formed in a single sweep of the mailer through the printing apparatus. The various mailers are formed from continuous sheets which are attached together and are separated into different pre-stuffed envelopes by perforated lines 134.

The form illustrated in FIG. 5 comprises an envelope, a customer copy of the bill, and a self-addressed return envelope. The envelope is formed by top sheet 112 and bottom or back sheet 118 which are adhered along their adjacent peripheral edges. Top sheet 112 forms the front face of the envelope and supports localized coatings 120 for printing the recipient's name and address, the return address, and other information, such as a request for an address correction.

Sheet 114 forms the customer's billing copy upon which the confidential billing information is imprinted. Coating 122 covers most of the surface of sheet 114, except for those areas for which no printing upon sheet 114 is desired. Since coating 122 extends beyond the boundaries of coatings 120 on sheet 112, the printing impact for the confidential billing information is applied against those areas of sheet 112 which are outside of the coatings 120. The printing of confidential billing information does not form a visible image on sheet 112, but does form visible images on sheet 114. In this manner, the confidential billing information only appears within the mailer and not on the envelope thereof without a record ply.

Sheet 116 forms a return envelope. Spot coatings 124 provided on sheet 116 permit individualized printing of the recipient's name and address and of the return address for separate mailers.

The invention will be further illustrated by the following examples. It should be understood that it is not intended to limit the scope of this invention.

EXAMPLE 1

Thirty grams of capsule slurry containing 0.2 gram of crystal violet lactone and 1.6 grams of polyvinylalcohol were made basic with 18 grams of ammonium hydroxide. Eighteen grams of melamine formaldehyde condensate were mixed into the resulting slurry. Nine grams of starch (commercially available as Keestar 327 from Kenkel Corporation) were added, followed by the addition of 12 grams of a phenolic novolac resin dispersion at 57 weight percent solids. The resulting mixture was spot-coated on the face side of mailers, using a two-roll gravure offset unit at a coat weight of about 2 pounds per 1,300 square feet of area.

The spot-coated mailers were processed on a computer printer without a ribbon. Dark blue images were developed within the coated area, while the other private (confidential) information did not appear outside the coated area.

EXAMPLE 2

To 510 grams of capsule slurry containing 6.3 grams of 2'-(bis-phenylmethylamine)-6'-(diethylamino)-4'-methyl-spiro[isobenzofluoran-1-(3H),9'-(9H)-xanthene]-3-one, 2.1 grams of a phthalide orange color former from Hilton-Davis, 0.9 gram of crystal violet lactone, 4.1 grams of a phthalide red color former from Hilton-Davis and 43.6 grams of benzylated gelatin were added the following materials in sequence: 280 grams of water, 450 grams of melamine formaldehyde condensate, 23 grams of ammonium hydroxide, 450 grams of the Keestar starch of Example 1, and 236 grams of phenolic novolac resin at 57% solids.

The resulting capsule slurry was then spot-coated on the face of mailers and also in the insert ply at about 3 pounds per 1,300 square feet of paper substrate.

Black images were obtained on those coated areas when processed on a computer printer, using a shield in the form of a blank ribbon free from chemically reactive material.

EXAMPLE 3

Three hundred grams of capsule slurry containing 3 grams of 6'-(cyclohexyl methylamino)-3'-methyl-2'-(phenylamino)-spiro[isobenzofluoran-1-(3H), 9'-(9H)xanthene]-3-one and 26.3 grams of gelatin were added to a mixture of 70 grams of titanium dioxide, 45 grams of vinyl acetate acrylic resin, 13 grams of ammonium hydroxide, and 20 grams of melamine formaldehyde condensate. Under a mild agitation, 400 grams of water, 200 grams of Keestar starch and 170 grams of a phenolic novolac resin dispersion at 47% solids were added to the slurry. The resulting mixture was spot-coated on the face of mailers and the inside plies at a coat weight of about 2 pounds per 1,300 square feet.

Black images were produced within the spot-coated areas on a computer printer without a ribbon.

What is claimed is:

1. A multi-ply mailer form, comprising a plurality of sheets in superposed relationship, wherein the top sheet comprises a support bearing a localized autogenous coating comprising an admixture of electron-acceptor material and chromogen-containing microscopic pressure-rupturable capsules, said localized autogenous coating being capable of reacting under the impact of a printing stylus to release said chromogen from said capsules for reaction with said electron acceptor material in said autogenous coating without transfer to provide a visible image comprising address information.

2. The form of claim 1 wherein at least one underlying sheet comprises a support bearing a second localized autogenous coating comprising both chromogen-containing microscopic pressure rupturable capsules and an electron acceptor material on its upper surface, said first and second localized autogenous coatings being non-coextensive.

3. The form of claim 2 wherein said form comprises a zig-zag folded stack of a plurality of elongated plies.

4. The form of claim 1 wherein at least one underlying sheet comprises a support bearing a localized coating of a transfer medium on its backside, said first localized coating and said localized coating containing said transfer medium being non-coextensive.

5. The form of claim 1 wherein the backside of said support bears a transfer coating.

6. The form of claim 1 wherein said electron acceptor material is an alkylphenol-formaldehyde novolac resin.

7. A printing system for producing printed multi-ply mailer forms consisting essentially of (a) a printing stylus for producing a visible image upon impact, (b) a multi-ply mailer form comprising a plurality of sheets in superposed relationship, wherein the top sheet comprises a support being a localized autogenous coating comprising an admixture of an electron acceptor material and microscopic pressure-rupturable capsules on its upper surface, said stylus forming a visible image upon impact with said localized autogenous coating by rupturing said capsules to release said chromogen from said capsules for reaction with said electron acceptor material in said localized autogenous coating without transfer.

8. The printing system of claim 7 wherein a non-reactive shielding means is interposed between said stylus and said autogenous coating to reduce the impact of said stylus upon said autogenous coating.

9. The printing system of claim 7 wherein the backside of said support bears a transfer coating.

10. The printing system of claim 7 wherein said printing stylus is a component of a computer printer.

11. The printing system of claim 7 wherein said electron acceptor is an alkylphenol-formaldehyde novolac resin.

12. A method for forming non-coextensive, visible images in a multi-ply mailer form which comprises contacting the top sheet of a multiple mailer form comprising a plurality of sheets in superposed relationship, wherein the top sheet comprises a support bearing a localized autogenous coating comprising an electron acceptor material and microscopic pressure-rupturable capsules containing a chromogenic material on its upper surface, with the printing stylus from an impact printer thereby providing a visible image in said localized, autogenous coating by rupturing said capsules to release said chromogen from said capsules for reaction with said electron acceptor material in said localized autogenous coating without transfer.

13. The method of claim 12 wherein said stylus directly contacts said localized autogenous coating.

14. The method of claim 12 wherein a nonreactive shielding means is interposed between said stylus and localized autogenous coating.

15. The method of claim 12 wherein at least one underlying sheet comprises a support bearing a second localized autogenous coating comprising chromogen-containing microscopic pressure rupturable capsules and an electron acceptor material on its upper surface, said first and second localized autogenous coatings being non-coextensive.

16. The method of claim 12 wherein at least one underlying sheet comprises a support bearing a localized coating of a transfer medium on its backside, said first localized coating and said localized coating of said transfer medium being non-coextensive.

17. The method of claim 12 wherein the backside of said support bears a transfer coating.

18. The method of claim 12 wherein said printing stylus is a component of a computer printer.

19. The method of claim 12 wherein said electron acceptor material is an alkylphenol formaldehyde novolac resin.

20. A multi-ply business form, comprising a plurality of sheets in superposed relationship, wherein the top sheet comprises a support bearing a localized autogenous coating comprising an admixture of electron acceptor material and chromogen-containing microscopic pressure-rupturable capsules on its upper surface, at least one underlying sheet comprising a support bearing a second localized autogenous coating comprising an admixture of an electron acceptor material and chromogen-containing microscopic pressure-rupturable capsules on its upper surface, said first and second localized autogenous coating being non-coextensive and do not overlap.

* * * * *

REEXAMINATION CERTIFICATE (830th)

United States Patent [19]

Chang

[11] B1 4,425,386

[45] Certificate Issued Mar. 29, 1988

[54] MULTI-SHEET ASSEMBLY USING AUTOGENOUS COATING

[75] Inventor: John C. H. Chang, Naperville, Ill.

[73] Assignee: Wallace Computer Services, Inc., Hillside, Ill.

Reexamination Request:
No. 90/001,167, Feb. 18, 1987

Reexamination Certificate for:

| | |
|---|---|
| Patent No.: | **4,425,386** |
| Issued: | **Jan. 10, 1984** |
| Appl. No.: | **395,870** |
| Filed: | **Jul. 7, 1982** |

[51] Int. Cl.[4] ..... B41M 5/16

[52] U.S. Cl. ..... 427/256; 101/DIG. 1; 229/68 R; 229/72; 229/75; 427/150; 427/151; 427/152; 427/153; 427/261; 427/288; 428/195; 428/211; 428/914; 503/201; 503/206; 503/226

[58] Field of Search ..... 101/DIG. 1; 229/68 R, 229/69, 71–73, 75, 81; 346/201, 206, 226; 427/150–153, 256, 261, 288; 428/195, 914, 207, 211, 411; 503/201, 206, 226

[56] References Cited

U.S. PATENT DOCUMENTS

| | | | |
|---|---|---|---|
| 3,016,308 | 1/1962 | Mccaulay | 503/215 |
| 3,419,286 | 12/1968 | Noonan et al. | 282/11.5 |
| 3,481,759 | 12/1969 | Ostlie | 503/206 |
| 3,791,572 | 2/1974 | Gendron | 229/69 |
| 3,914,511 | 10/1975 | Vassiliades | 427/150 |
| 4,010,292 | 3/1977 | Shackle et al. | 427/150 |

OTHER PUBLICATIONS

Research disclosure 18747 (Nov. 1979).

*Primary Examiner*—Bruce H. Hess

[57] ABSTRACT

A multi-ply business form comprising a plurality of sheets in superposed relationship wherein the top sheet comprises a support bearing a localized coating comprising both microscopic pressure rupturable capsules containing a chromogenic material, and an electron acceptor material. At least one underlying sheet can comprise a support bearing a second localized autogenous coating comprising chromogen-containing microscopic pressure rupturable capsules and an electron acceptor material on its upper surface wherein the localized autogenous coatings are non-coextensive.

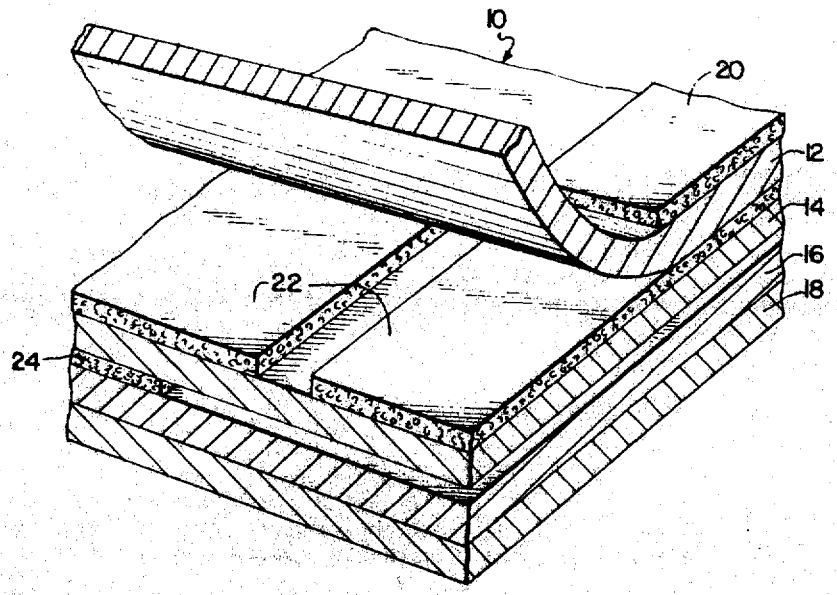

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the atent, but has been deleted and is no longer a part of the atent; matter printed in italics indicates additions made › the patent.

ıS A RESULT OF REEXAMINATION, IT HAS BEEN DETERMINED THAT:

The patentability of claims 12–20 is confirmed.

Claims 1 and 7 are determined to be patentable as nended.

Claims 2–6 and 8–11, dependent on an amended aim, are determined to be patentable.

New claims 21–48 are added and determined to be ıtentable.

1. A multi-ply mailer form, comprising a plurality of ıeets in superposed relationship, wherein the top sheet ›mprises a support bearing a localized autogenous ›ating comprising an admixture of electron-acceptor aterial and chromogen-containing microscopic pres-ıre-rupturable capsules *on its upper surface*, said local-ed autogenous coating being capable of reacting under e impact of a printing stylus to release said chromo-:n from said capsules for reaction with said electron :ceptor material in said autogenous coating without ansfer to provide a visible image comprising address formation.

7. A printing system for producing printed multi-ply ailer forms consisting essentially of (a) a printing stylus for producing a visible image upon impact, (b) a multi-ply mailer form comprising a plurality of sheets in superposed relationship, wherein the top sheet comprises a support [being] *bearing* a local-ized autogenous coating comprising an admixture of an electron acceptor material and microscopic pressure-rupturable capsules on its upper surface, said stylus forming a visible image upon impact with said localized autogenous coating by rupturing said capsules to release said chromogen from said capsules for reaction with said electron acceptor material in said localized autogenous coating without transfer.

*21. The form of claim 1 wherein said form comprises a ·-zag folded stack of a plurality of elongated plies.*

*22. The form of claim 1 wherein said form comprises a ırality of elongated plies.*

*23. The form of claim 22 wherein said top sheet of said ırality of plies is formed from a single elongated ply and 'd top sheet is separated into individual mailer envelope ›nts by lines of perforation.*

*24. The form of claim 23 wherein the upper surface of :h of said individual mailer envelope fronts bears a plu-'ity of localized autogenous coatings.*

*25. The form of claim 22 wherein said elongated plies ›m a plurality of mailers directly connected end-to-end lines of perforations.*

*26. The form of claim 25 wherein the upper surface of the top sheet of each mailer bears a plurality of localized autogenous coatings.*

*27. The form of claim 1 wherein said coating comprises a color suppressant.*

*28. The form of claim 27 wherein said color suppressant is ammonium hydroxide.*

*29. The printing system of claim 8 wherein said non-reactive shielding means is a synthetic fabric.*

*30. The printing system of claim 8 wherein said non-reactive shielding means is a blank ribbon free from chemically reactive material.*

*31. The printing system of claim 8 wherein said stylus directly contacts said non-reactive shielding means.*

*32. The printing system of claim 7 wherein said stylus directly contacts said localized autogenous coating.*

*33. The printing system of claim 7 wherein said form comprises a plurality of elongated plies.*

*34. The printing system of claim 33 wherein said top sheet of said plurality of plies is formed from a single elongated ply and said top sheet is separated into individual mailer envelope fronts by lines of perforations.*

*35. The printing system of claim 34 wherein the upper surface of each of the individual mailer envelope fronts bears a plurality of localized autogenous coatings.*

*36. The printing system of claim 33 wherein said mailer form comprises a plurality of individual mailers directly connected end-to-end by lines of perforations in said mailer form.*

*37. The printing system of claim 36 wherein the upper surface of the top sheet of each of the individual mailers bears a plurality of autogenous coatings.*

*38. The printing system of claim 7 wherein said localized autogenous coating comprises a color suppressant.*

*39. The method of claim 12 wherein said autogenous coating is formed by providing a slurry comprising a mixture of microscopic pressure-rupturable capsules and electron acceptor material in a feed tray means, rotating an etched gravure cylinder means in said feed tray means to pick up portions of such slurry and transfer such slurry to a plate supported on a rotating roll coming in contact with said etched gravure roll means, and transferring said slurry from said plate means to said support to provide said localized autogenous coating.*

*40. The method of claim 14 wherein said non-reactive shielding means comprises a synthetic fabric.*

*41. The method of claim 14 wherein said non-reactive shielding means is a blank ribbon free from chemically reactive material.*

*42. The method of claim 12 wherein said mailer form comprises a plurality of elongated plies.*

*43. The method of claim 42 wherein said top sheet of said plurality of plies is formed from a single elongated ply and said top sheet is separated into individual mailer envelope fronts by lines of perforations.*

*44. The method of claim 43 wherein the upper surface of each of said individual mailer envelope fronts bears a plurality of localized autogenous coatings.*

*45. The method of claim 42 wherein said plurality of mailers are directly connected end-to-end by lines of perforations in said mailer form.*

*46. The method of claim 45 wherein the top sheet comprises individual mailer envelope fronts bearing a plurality of localized autogenous coatings on its upper surface.*

*47. The method of claim 12 wherein said localized autogenous coating is formed by applying a mixture of microscopic pressure-rupturable capsules containing a chromogenic material and an electron acceptor material to said support in the form of a slurry.*

*48. The method of claim 12 wherein said localized autogenous coating comprises a color suppressant.*

* * * * *